US010278444B2

(12) United States Patent
Merrell

(10) Patent No.: US 10,278,444 B2
(45) Date of Patent: May 7, 2019

(54) PROTECTIVE HELMET

(71) Applicant: Scott P. Merrell, Norwalk, CT (US)

(72) Inventor: Scott P. Merrell, Norwalk, CT (US)

( * ) Notice: Subject to any disclaimer, the term of this patent is extended or adjusted under 35 U.S.C. 154(b) by 139 days.

(21) Appl. No.: 14/814,579

(22) Filed: Jul. 31, 2015

(65) Prior Publication Data

US 2016/0270471 A1 Sep. 22, 2016

Related U.S. Application Data

(60) Provisional application No. 62/135,304, filed on Mar. 19, 2015.

(51) Int. Cl.
*A42B 3/12* (2006.01)

(52) U.S. Cl.
CPC ..... *A42B 3/121* (2013.01)

(58) Field of Classification Search
CPC ..... A42B 3/121; A42B 3/18; A42B 3/069
See application file for complete search history.

(56) References Cited

U.S. PATENT DOCUMENTS 3,600,714 A 8/1971 Cade, Jr. et al.
3,999,220 A 12/1976 Keltner
4,124,904 A 11/1978 Matthes
4,324,005 A 4/1982 Willis
4,663,785 A 5/1987 Comparetto
5,318,018 A * 6/1994 Puma ..... A62B 17/008 128/202.11
6,997,218 B1 * 2/2006 Garcia ..... F41H 1/02 141/98
8,046,845 B1 * 11/2011 Garcia ..... A42B 3/061 2/2.5
8,615,817 B2 * 12/2013 Phillips ..... A42B 3/064 2/2.5
8,713,716 B2 5/2014 Krueger
8,719,967 B2 5/2014 Milsom
8,881,315 B2 11/2014 Desjardins et al.
8,938,818 B2 1/2015 Ide et al.
8,947,195 B1 2/2015 Anvari
2005/0273911 A1 12/2005 Skiba et al.
2007/0000025 A1 * 1/2007 Picotte ..... A42B 1/08 2/171
2007/0190293 A1 8/2007 Ferrara
2009/0018242 A1 * 1/2009 Kailasam ..... C08F 283/04 524/139
2012/0210490 A1 8/2012 Harty

OTHER PUBLICATIONS

International Search Report issued in International Application No. PCT/US16/22552 dated Jun. 30, 2016.
Written Opinion of the International Searching Authority issued in International Application No. PCT/US16/22552 dated Jun. 30, 2016.

* cited by examiner

*Primary Examiner* — Khaled Annis
(74) *Attorney, Agent, or Firm* — Wenderoth, Lind & Ponack, L.L.P.

(57) ABSTRACT

The invention provides a unique construction for a sports helmet, as well as a novel approach to protecting the head of a sports player from head injury. The helmet of this invention is comprised of an outer layer comprised of a flexible material, an inner layer comprised of a flexible material, wherein the outer layer and inner layer define a space layer, wherein the space layer contains a gas, gel or liquid, and wherein the inner layer of the helmet is configured to fit around a human head.

6 Claims, 7 Drawing Sheets

PROTECTIVE HELMET

BACKGROUND OF THE INVENTION

1. Field of the Invention

The invention is in the field of protective helmets for sports, the military, and the like.

2. Background Art

Sports helmets are well known. Early sports helmets were made of leather. Modern sports helmets typically have an exterior shell made of a rigid injection molded resin with an inner layer of padding to protect the player's head. Some of these conventional sports helmets include an inflatable bladder. See for example U.S. Pat. No. 8,881,315. For other helmet constructions, see U.S. Pat. Nos. 8,938,818, 8,947,195, 8,713,716 and U.S. Pat. No. 8,719,967. The disclosures of the foregoing U.S. patents are incorporated by reference herein.

Virtually all sports and military helmets include a rigid impact resistant shell made of various materials. For example, modern football helmets often have a tough rigid impact resistant outer shell made of polycarbonate alloy plastic. Another material used widely in protective headgear is ABS polymer (Acrylonitrile Butadiene Styrene). Bicycle helmets have an outer shell made of an impact absorbing molded expanded polystyrene foam. Modern military helmets have a rigid impact resistant outer shell containing Kevlar. All of the materials making up the rigid outer shell of such helmets are lightweight, durable, strong, and rigid. The materials have good shock absorbance and impact resistance.

BRIEF SUMMARY OF THE INVENTION

The invention provides a unique construction for a sports helmet, as well as a novel approach to protecting the head of sports players or military personnel from head injury. The protective helmet of this invention does not contain any rigid impact resistant layer such as found in virtually all helmets known today. The basic construction of the helmet of this invention is comprised of an outer layer comprised of a flexible material, an inner layer comprised of a flexible material, and a space layer defined by and disposed between the outer layer and inner layer. The space layer is sealed so that it is capable of containing a gas, gel or liquid. The inner layer of the helmet is configured to fit around a human head. Numerous embodiments of the invention utilizing this basic construction are described in detail hereinbelow.

DETAILED DESCRIPTION OF THE INVENTION

Figure 1:
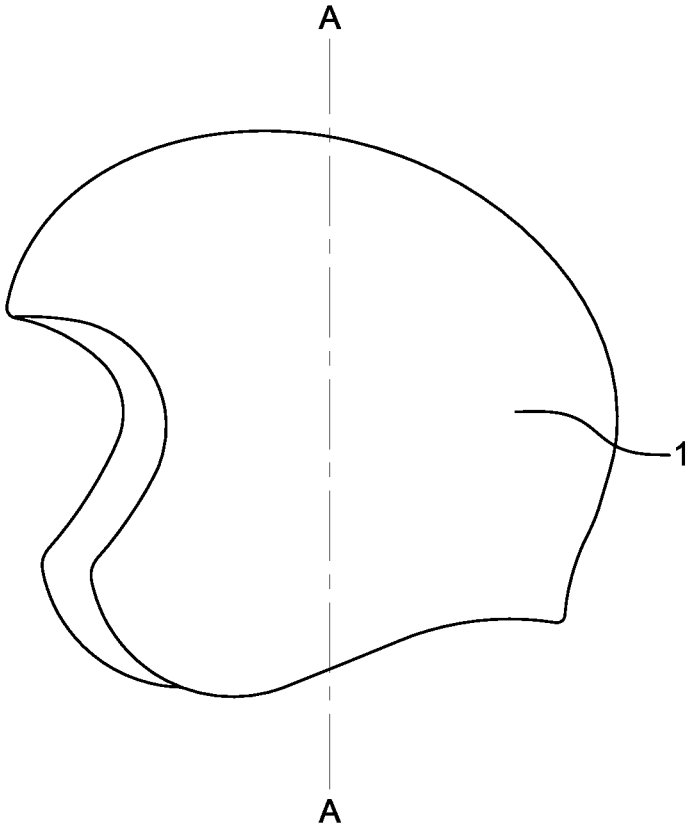
FIG. 1 is a left side perspective view of an embodiment of a protective helmet 1 of the invention.
Figure 2:
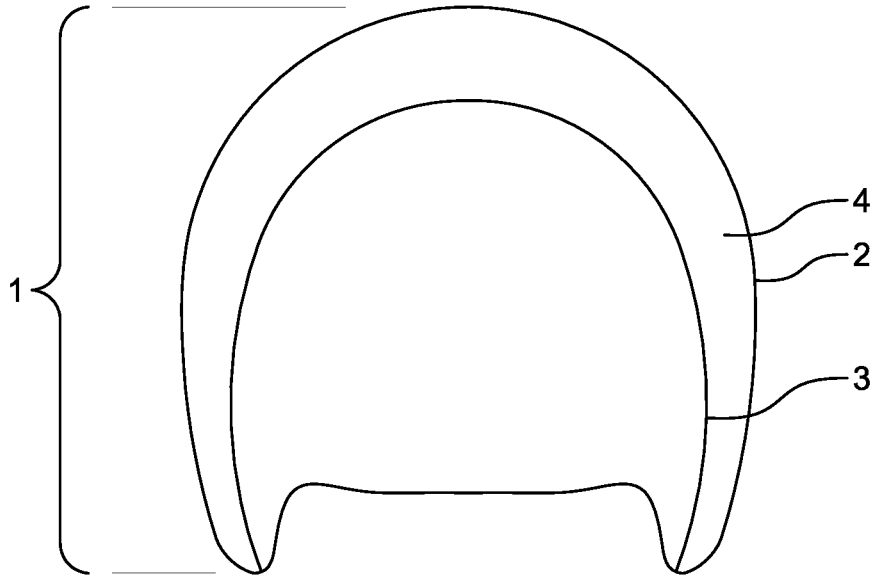
FIG. 2 is a front cross-sectional view of the helmet 1 shown in FIG. 1 along line A-A. The helmet 1 comprises an outer layer 2, and an inner layer 3, wherein the outer layer 2 and the inner layer 3 define a space layer 4.
Figure 3:
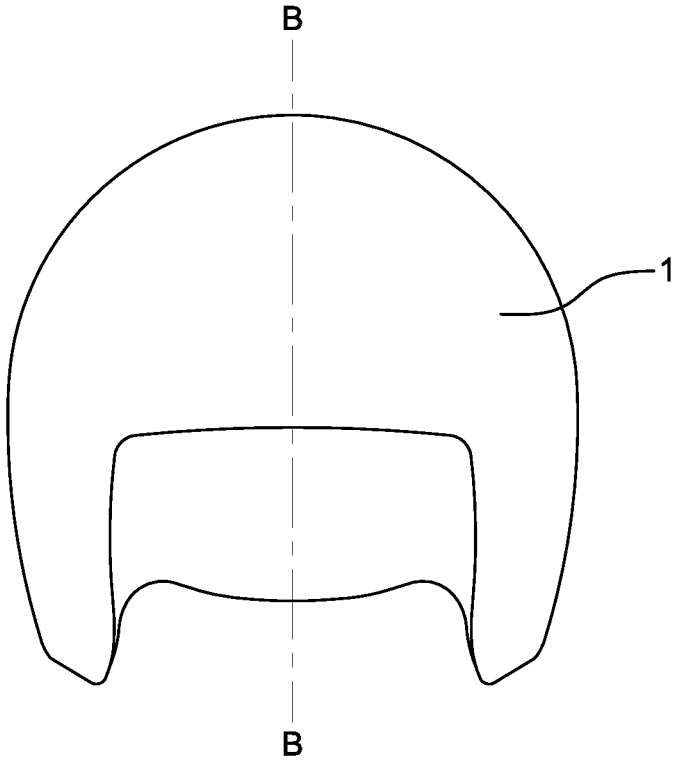
FIG. 3 is a front elevational view of the helmet 1 shown in FIG. 1.
Figure 4:
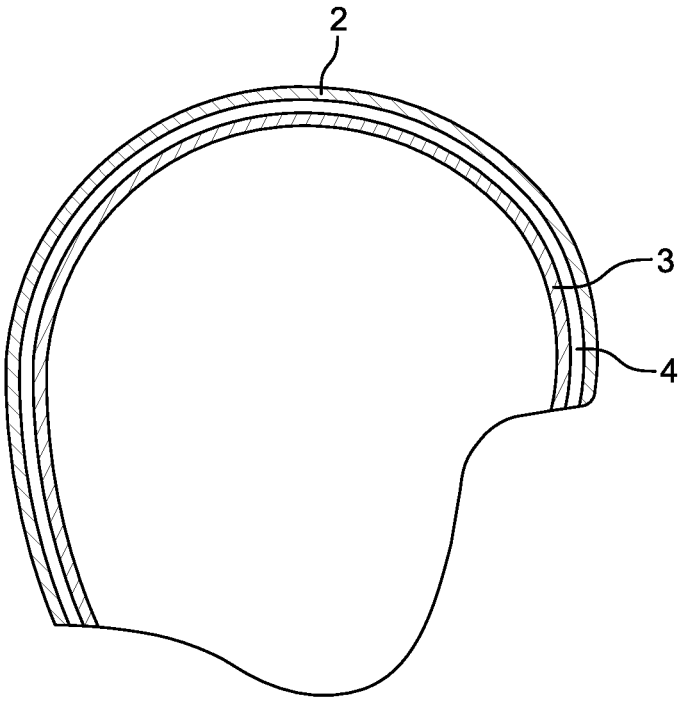
FIG. 4 is a right side cross-sectional view of the helmet 1 shown in FIG. 3 along line B-B. The helmet 1 comprises an outer layer 2, and an inner layer 3, wherein the outer layer 2 and the inner layer 3 define a space layer 4. The layers of the helmet are shown in more detail than in FIG. 2.

The helmet of this invention is comprised of an outer layer comprised of a flexible material, an inner layer comprised of a flexible material, and a space layer defined by and disposed between the outer layer and inner layer. The space layer is a sealed cavity, so that it is capable of containing a gas, gel or liquid. The space layer is sealed so that it may contain the gas, gel or liquid under pressure. The space layer may optionally include a valve, port or other closure device for filling or releasing the gas, gel or liquid contents therein. For example, the device for filling and releasing the gas, gel or liquid from the space layer may be an conventional closure device which is known for allowing a container containing a gas, gel or liquid to be opened and closed, e.g. a bicycle tire valve, a closure device found on inflatable swimming pools, etc. Alternatively the space layer may be filled with the gas, gel or liquid during construction of the space layer so that the contents are permanently contained in the space layer. The inner layer of the helmet may be configured to fit around a human head.

The helmet of this invention may have any number of additional layers, for example from 3 to 10 layers of material. Each layer of the helmet may be the same or different. The outer layer and inner layer defining the space layer may be any layer of the helmet, so long as the inner layer is more proximate to the wearer's head than the outer layer, and the outer layer is disposed on the opposite side of the inner layer from the wearer's head. Each layer may be a single uniform sheet of material, or a plurality of sheets of material, or each layer may independently be composed of a plurality of segments which are joined together to create the layer. The helmet may include more than one space layer.

Each layer of the helmet, other than the space layer, may be comprised of any suitable flexible material, for example a natural or synthetic fabric material, such as cotton, wool, nylon, silk, vinyl, polyester, polyurethane, rayon, acrylic, rubber, plastic, resin, foam, other natural or synthetic polymer materials, and mixtures thereof. Preferably the material is elastic. The combined thickness of all layers of the helmet is not limited but is preferably 2 inches to 7 inches in thickness. The thickness of each layer of the helmet is not limited, but the inner and outer layers are preferably 0.01 inch to 0.5 inch thick, the space layer containing air or liquid is preferably ¾ inch to 1½ inches, and the space layer containing gel is preferably ½ inch.

Each layer of the helmet may be coated on one or both sides with a paint, coloring agent, waterproofing agent, wear resistant agent, water resistant agent, etc. Preferably the outermost layer of the helmet is constructed so that it may decorated with a preselected color, team logo, design, etc.

The space layer defined by the outer and inner layers may contain a gas, such as $O_2$ or $N_2$, or a gas mixture such as air. The space layer alternatively may contain a liquid, such as water, an aqueous solution, a gel, a pliable foam and the like. The gas may be pressurized. Preferably the space layer contains pressurized air. The pressure of the gas may be between 1 atm to 100 atm, preferably 2 atm to 35 atm.

The helmet may be adapted for any sport, for example football, lacrosse, hockey, horse racing, motorcycle riding, bicycle riding, etc. The helmet may also be adapted for military purposes, automotive racing, etc. The helmet may include heat pads or coolers, to maintain the head of the wearer at a comfortable temperature. The helmet may include a face bar, chin strap, face shield, cellular telephone components, a speaker, a microphone, wireless internet components, and/or a radio. The helmet may contains its own power source, such as a battery, or may have an electrical cord to connect to a power source, carried on the wearer or accessible near the wearer, such as in the wearer's vehicle. These accessories may be attached to one or more layer of the helmet of this invention by any conventional means, for example by glue, stitching, velcro, etc.

Figure 5:
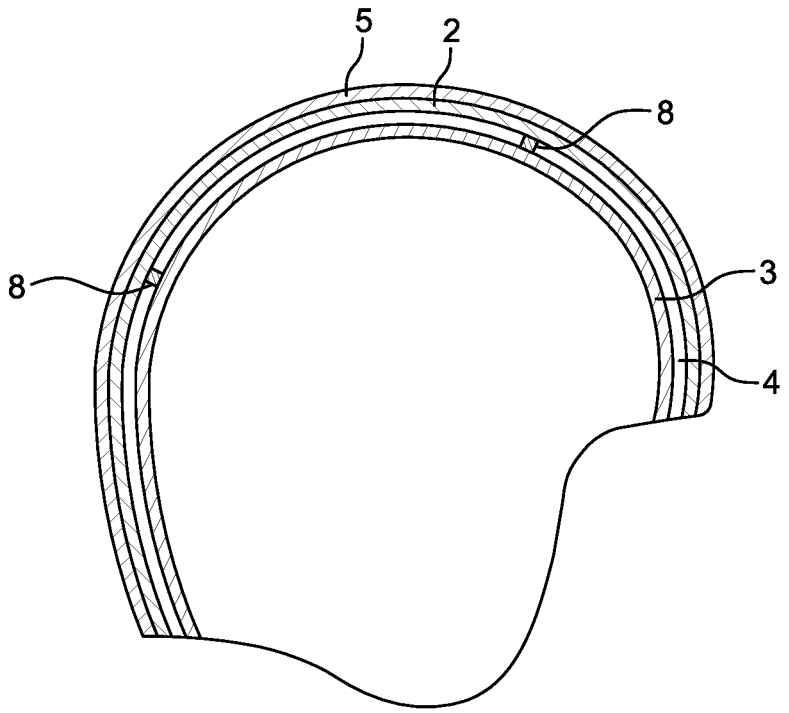
FIG. 5 is a right side cross-sectional view of another embodiment of the helmet 1 according to the invention. The helmet 1 comprises a high strength fiber outer layer 5, an outer layer 2, and an inner layer 3, wherein the outer layer 2 and the inner layer 3 define a space layer 4. Also provided are provided a plurality of walls 8 which connect the outer layer 2 and the inner layer 3 to form partitions in the space layer 4.
Figure 6:
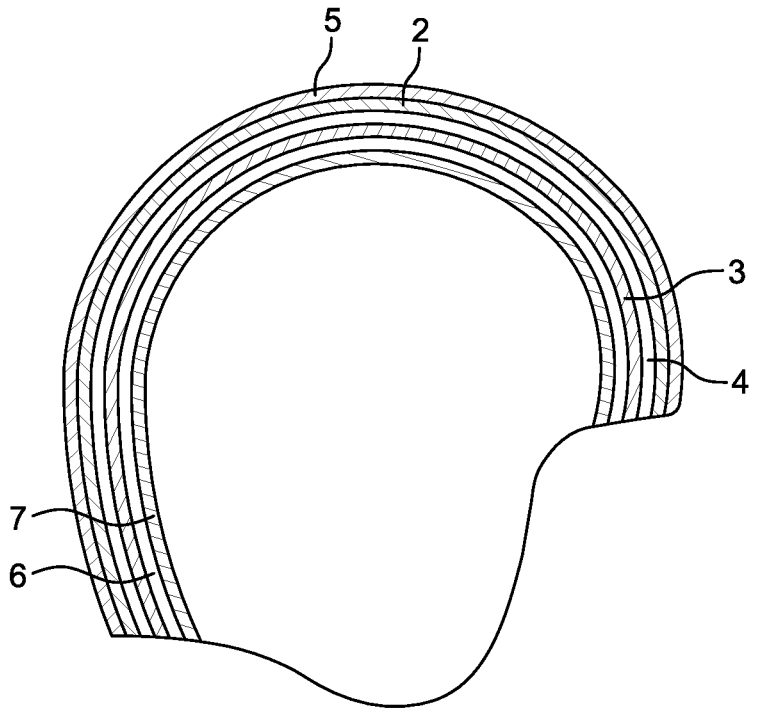
FIG. 6 is a right side cross-sectional view of another embodiment of the helmet 1 according to the invention. The helmet 1 comprises a high strength fiber outer layer 5, an outer layer 2, and an inner layer 3, wherein the outer layer 2 and the inner layer 3 define a first space layer 4. Also provided is a further inner layer 7, wherein the inner layer 3 and the inner layer 7 define a second space layer 6.

The layers of the helmet forming a space layer may be joined at the peripheral edges by any suitable means, for example by mechanical, thermal or chemical means, such as stitching, glue, fusion, molding, etc. The layers may be optionally joined to one another at other locations away from the peripheral edges, for example by walls 8 as shown in FIG. 5. Walls 8 may connect the inner layer 3 and outer layer 2 to form partitions in the space layer 4. Partitions may prevent total leakage of the contents of the space layer in the event there is a puncture or rupture of the inner layer or outer layer forming one partition section of the space layer. Layers of the helmet which do not form a space layer and are adjacent to each other, may be adhered or connected to each other by glue, foam, velcro, etc., or the layers may simply contact each other and not adhered to each other.

The outer and inner layers may define the space layer by any means to provide a secure container for the gas, gel or liquid. Alternatively, the outer and inner layers may define the space layer, and the space layer may contain an inflatable bladder to contain the air or liquid. Inflatable bladders are described in the U.S. patents discussed above. The helmet of this invention uses an internal air or liquid layer for impact reduction. Preferably the helmet of this invention does not include elastically resilient impressions of carbon fiber or carbon nanotube layers between the outer and inner layers as taught by U.S. Pat. No. 8,713,716, FIGS. 15-17, which U.S. patent disclosure is incorporated by reference herein.

According to the invention, the helmet has no rigid impact resistant layer. All layers of the helmet are flexible. The term "rigid" layer means that the layer does not bend under a normal force applied to the layer. In other words, a rigid layer is not forced out of shape, and is not flexible. Rigid layers are characteristic of conventional protective helmets, which have an outer shell that is stiff, hard, firm, inelastic and inflexible.

For example, in a football helmet of this invention, the helmet of the invention has no layer which is rigid and which does not bend when a player is struck on the helmet by another player's helmet or body. Every layer of the helmet is flexible. The term "flexible" layer means that the layer does bend without breaking and is forced out of shape under a normal force applied to the layer. The impact absorbing component of the helmet is the space layer containing the gas, gel or liquid.

One or more layers of the helmet may contain a high strength synthetic fiber, such as Kevlar. When Kevlar is spun, the resulting fiber has a tensile strength of about 3,620 MPa, and a relative density of 1.44. Kevlar and similar fibers are a common component of many products, such as bullet proof vests and tires. This high-strength material may be incorporated into the layer as a fiber or as a sheet. The layer may be totally comprised of the high strength material, or be an ingredient of the layer in a composite material. Any high strength fiber similar to Kevlar is suitable for use in one or more layers of the helmet. Preferably the outer layer comprises a high strength synthetic fiber material.

The helmet of this invention is preferably constructed to cover the wearer's head, excluding the face portion. This construction is popular in sports helmets and essentially covers the head of the wearer from the forehead, over the ears, and the top of the neck. The helmet may optionally be larger in some uses, such as military uses, and race car driving, to cover the neck and/or the face, when these areas are desired to be protected. The helmet may include openings, such as over the eyes, nose, ears, or other locations, which openings are constructed through all layers of the helmet, to allow for sight, hearing, cooling, breathing, heat escape, etc.

Figure 7:
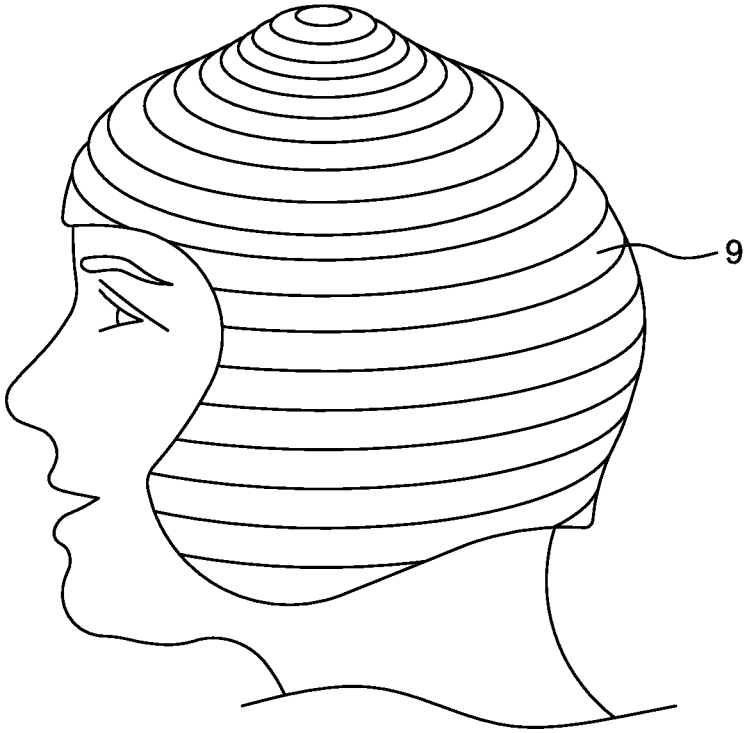
FIG. 7 illustrates an alternative embodiment of a space layer formed from a sealed elastic tube 9 which is coiled to inside the helmet to surround the wearer's head. An outer layer covering the coiled elastic tube layer 9 is not shown.

The space layer is not restricted to being formed from an outer and inner layer. Any construction of the space layer may be used in the present invention so long it is capable of containing a gas, gel or liquid. An alternative embodiment of the invention for forming a space layer uses an elastic tube. The elastic tube is sealed at both ends so that it may contain a gas, gel or liquid. Preferably the elastic tube is filled with compressed air as a protective air layer. The elastic tube may be similar in size and composition to a typical one inch bicycle tire inner tube. Preferably the tube has closed ends for forming the sealed cavity to be filled with gas, gel or liquid. The tube may include a valve or other closure device for filling and emptying the cavity of the gas, gel or liquid. The tube may be folded or inserted into the helmet any configuration. The tube should be capable of being inflated at a pressure of 5 to 150 psi of compressed air. The tube may be provided with a means for inflating or deflating the tube with compressed air, such as a bicycle valve or any known valve mechanism. The elastic tube is preferably coiled to fit around the wearer's head and is disposed inside an outer layer of the helmet. See FIG. 7. For example, the inner tube may be coiled in the shape of a "snake coil". The coiled tube absorbs the shock of an impact and diffuses the impact forces over the entire surface of the head, not just at the point of impact.

Another preferred embodiment of the invention for forming a space layer uses two elastic layers, similar to an elastic bathing or swimming cap, wherein a first cap is inserted inside of a second cap, and the first and second cap edges are sealed at the edges to form the space layer. The space layer preferably contains a compressed air or a gel. When the sealed layers hold air, the sealed layers may be capable of being inflated at a pressure of 5 to 150 psi of compressed air. The sealed layers may be provided with a means for inflating or deflating the layers with compressed air, such as a bicycle valve or any known valve mechanism. A similar valve device may be used if the sealed layers are filled with a gel. The gel may be selected so that it is capable of being heated or cooled and retaining such temperature. Thus a wearer may heat the space layer containing the gel, or the helmet itself, and use the helmet in the winter to provide warmth to the head. In addition, a wearer may chill the gel and use the helmet in the summer to provide cooling to the head.

A preferred embodiment of the invention is constructed of an outer layer made from Kevlar, and a space layer which is disposed inside the Kevlar layer and which is made of the coiled elastic tube filled with compressed air.

Another preferred embodiment of the invention is constructed of an outer layer made from Kevlar, a first space layer disposed inside the Kevlar layer and made of the coiled elastic tube filled with compressed air as a first air protective layer, and a second space layer disposed inside the first space layer, wherein the second space layer is formed of two sealed elastic layers filled with compressed air which form a second air protective layer.

Another preferred embodiment of the invention is constructed of an outer layer made from Kevlar, a first space layer inside the Kevlar layer and made of the coiled elastic tube filled with compressed air as an outer air protective layer, a second space layer disposed inside the first space layer, wherein the second space layer is formed of two sealed elastic layers filled with gel to form an inner gel protective layer.

Another preferred embodiment of the invention is constructed of an outer layer made from Kevlar, a first space layer inside the Kevlar layer and made of the coiled elastic tube filled with compressed air as an outer air protective layer, a second space layer disposed inside the first space layer, wherein the second space layer is formed of two sealed elastic layers filled with gel to form an inner gel protective layer, and an innermost layer disposed inside the second space layer which is a removable and washable absorbent fabric liner.

Another preferred embodiment of the invention is constructed of an outer layer made from Kevlar, a first space layer inside the Kevlar layer and made of the coiled elastic tube filled with compressed air as an outer air protective layer, a second space layer disposed inside the first space layer, wherein the second space layer is formed of two sealed elastic layers filled with compressed air which form a second air protective layer, a third space layer disposed inside the second space layer, wherein the third space layer is formed of two sealed elastic layers filled with gel to form an inner gel protective layer, and an innermost layer disposed inside the third space layer which is a removable and washable absorbent fabric liner.

One major advantage of the invention is that the helmet of this invention is very light. For example, an NFL helmet weighs 17-20 lbs. In contrast, the helmet of this invention can be designed to weigh about 1-10 lbs, preferably 2-6 lbs, more preferably 2-3 lbs. Due to its larger weight, the NFL helmet has a large mass on a collision, which creates a large force on the human skull on impact. The NFL helmet weight itself greatly contributes to the risk of concussion. Thus the helmet of this invention greatly reduces the risk of concussion based upon its reduced weight. Since all conventional helmets are based upon a similar construction as the NFL helmet, using a heavy rigid layer or outer shell, all conventional helmets suffer from this same risk of concussion on impact. The helmet of the present invention is a revolutionary design for protecting the head of the wearer, using an air pressure filled layer to absorb impact, while reducing the weight of the helmet.

The invention claimed is:

1. A protective helmet for reducing a risk of concussion, consisting of:

an single outer layer comprised of a flexible material adapted to extend on an entire head of a wearer when worn, an single inner layer comprised of a flexible material adapted to extend on the entire head of the wearer when worn, wherein the outer layer and inner layer define a single uninterrupted space layer, wherein the single space layer is a sealed cavity which consists of a gas, gel or liquid, wherein the flexible material of at least one of the outer layer or the inner layer comprises a high strength synthetic fiber material, wherein the helmet is constructed to cover a wearer's head, and wherein the helmet has no rigid impact resistant layer.

2. The helmet according to claim 1, wherein the outer layer comprises a high strength synthetic fiber material.

3. The helmet according to claim 1, wherein the high strength synthetic fiber material has a tensile strength of about 3,620 MPa.

4. The helmet according to claim 1, wherein the space layer contains a gel.

5. The helmet according to claim 1, wherein the space layer contains pressurized air.

6. The helmet according to claim 1, wherein the space layer contains a liquid.

* * * * *